US008134463B2

(12) United States Patent
Black

(10) Patent No.: US 8,134,463 B2
(45) Date of Patent: Mar. 13, 2012

(54) WHEELCHAIR ACCESSORY

(76) Inventor: Laurthera Black, Tulsa, OK (US)

( * ) Notice: Subject to any disclaimer, the term of this patent is extended or adjusted under 35 U.S.C. 154(b) by 406 days.

(21) Appl. No.: 12/539,021

(22) Filed: Aug. 11, 2009

(65) Prior Publication Data

US 2010/0141438 A1 Jun. 10, 2010

Related U.S. Application Data

(60) Provisional application No. 61/201,208, filed on Dec. 9, 2008.

(51) Int. Cl.
*G08B 21/00* (2006.01)

(52) U.S. Cl. ..... 340/540; 340/901; 340/425.5

(58) Field of Classification Search ..... 340/540
See application file for complete search history.

(56) References Cited

U.S. PATENT DOCUMENTS 4,178,625 A * 12/1979 Schudel ..... 362/131
4,856,452 A * 8/1989 Pingel et al. ..... 114/364
5,349,340 A * 9/1994 Blumenthal ..... 340/574
5,518,214 A * 5/1996 Spencer ..... 248/205.2
5,791,761 A * 8/1998 Bryant et al. ..... 362/131
6,254,116 B1 * 7/2001 Szumlic et al. ..... 280/304.1
6,965,311 B1 * 11/2005 Karner ..... 340/539.12
7,651,242 B1 * 1/2010 Guerrant ..... 362/286
2006/0207493 A1 * 9/2006 Chasmar ..... 116/173
2007/0283875 A1 * 12/2007 Durkin ..... 116/173
2009/0008899 A1 * 1/2009 Blankenship et al. ..... 280/288.4
2009/0165698 A1 * 7/2009 Lapkin ..... 116/173

* cited by examiner

*Primary Examiner* — George Bugg
*Assistant Examiner* — Kerri McNally

(57) ABSTRACT

My invention is an improvement upon the previously existing wheelchair warning lamp apparatus that fails to allow the wheelchair to fold and be used indoors when installed onto the wheelchair and require drilling to be installed. My apparatus, a clamp-on extendible and retractable cylinder shaped erected pole has a safety light and an audible alert equipment installed on top of the inner casing and a pole lock nut installed on the outer casing whereas the outer pole casing is attached to the battery housing support member with three C-Clamps vertically and horizontally attached on the battery housing allowing the pole and battery safety light assembly with audible alert apparatus to be clamped onto one side only of the wheelchair without drilling required and allows the chair to fold and be used indoors without removal of the installed pole and battery with safety light with audible alert apparatus from the wheelchair.

17 Claims, 3 Drawing Sheets

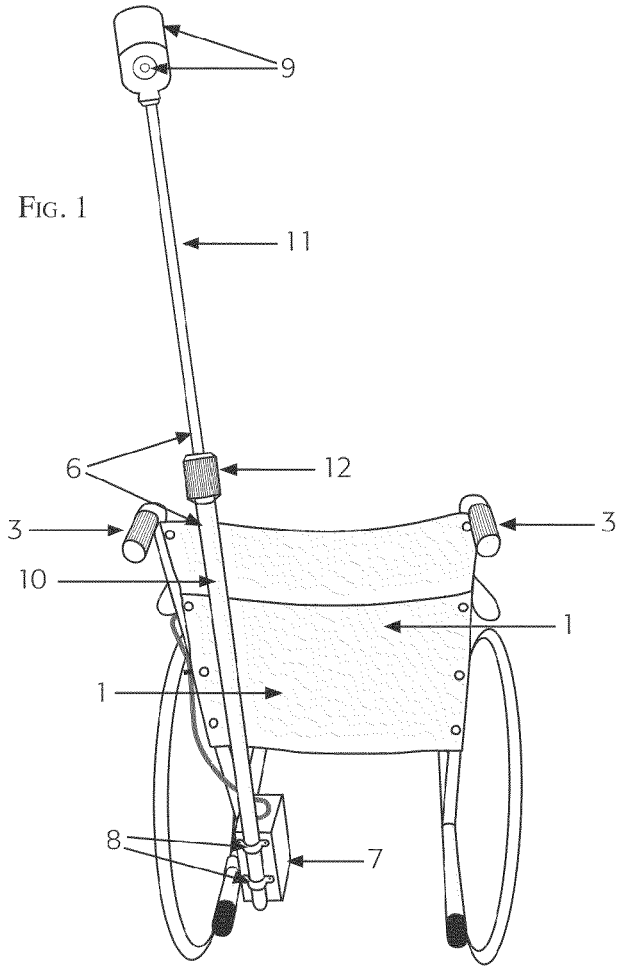
FIG. 1
FIG. 2
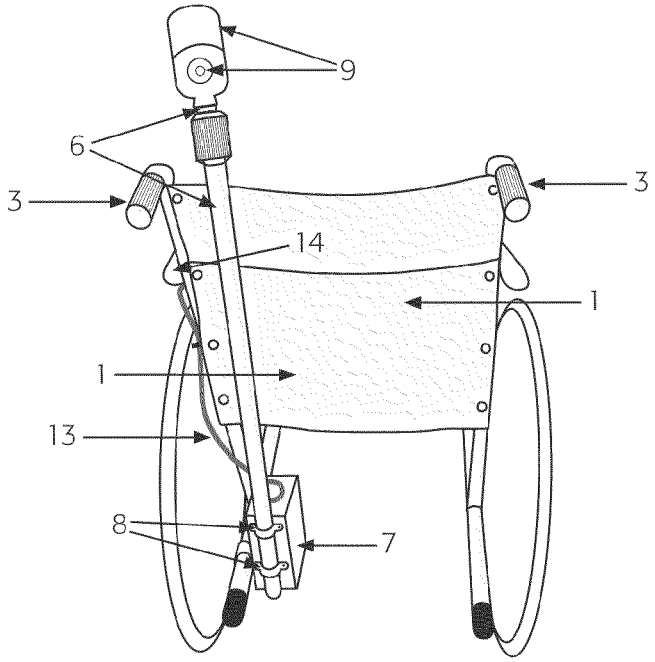

WHEELCHAIR ACCESSORY

BACKGROUND OF THE INVENTION

1. Field of the Invention

This present invention relates to wheelchair accessories. More specifically, this invention is an improvement upon the alignment, mounting and installation of the previously existing wheelchair warning lamp apparatus that failed to allow the wheelchair to be folded or used indoors without removal of the installed warning lamp apparatus from the wheelchair and required drilling holes into the wheelchair in order to be installed onto the wheelchair.

2. Description of the Related Art

For more than five hundred years wheelchairs have existed, and while there is not any portable overhead upright wheelchair warning lamp apparatus being made available to wheelchair users today there is a previously existing wheelchair warning lamp apparatus, but it has failed to allow the wheelchair to be folded or used indoors when it is installed onto the wheelchair. As documented in the ABSTRACT of U.S. Pat. No. 5,791,761 which issued on Aug. 11, 1998 to Connie Bryant, the patent states, "The apparatus may be readily removed when the wheelchair is used indoors or quickly, installed when the wheelchair is to be used out of doors."

Also stated in the DESCRIPTION OF THE INVENTION for U.S. Pat. No. 5,791,761 it is documented "It is also necessary to drill through the guide support arms 23 and the underlying frame to provide holes for the spring loaded buttons 32." One problem with this previous apparatus is wheelchair users using rental wheelchairs would not be able to install the apparatus onto their rental wheelchair since drilling is required. Their only alternative is to go without and remain at risk.

In addition, in the BACKGROUND OF THE INVENTION of U.S. Pat. No. 5,791,761 the patent states "one problem with mounting a warning lamp on a wheelchair for use in traffic is that it is difficult to adequately and removably support such a lamp to a wheelchair, so that it may be removed when the wheelchair is folded or used indoors." This statement was referring to U.S. Pat. No. 5,791,761 for Wheelchair Warning Lamp Umbrella and Accessory Storage Apparatus, filed Jul. 1, 1996 and issued to Connie Bryant on Aug. 11, 1998. In regards to this previous statement, the reason it is difficult to fold the wheelchair with the installed apparatus mounted onto the wheelchair is the configuration of the apparatus in relationship to the alignment of the wheelchair does not allow for best functions of both apparatus particularly for the wheelchair to perform properly.

In the ABSTRACT of the patent, the mounting base for the apparatus as described, "is a generally horizontal U shaped member having a box connected thereto and the U-shaped member slidingly received in a rear upper portion of the wheelchair. The Box is adapted to carry the umbrella support arm and provide accessory storage for the rider." The Box size in the DESCRIPTION OF THE INVENTION for U.S. Pat. No. 5,791,761 is described as, "The Box 44, forming part of the mounting base 34 is generally 12" high, 6" wide and 18" long. While the U shape member 30 is made from metal tubing the box 34 may be either made of metal or extruded plastic. It is also suggested that in smaller wheelchairs the box may be of reduced length, say 12" instead of 18".

Nevertheless, the alignment, mounting, installation and structure of the installed previous apparatus are unsuitable for the operational use of the wheelchair. The size and location of the mounting base with the connecting box places restrictions on the wheelchair and user and prevents the wheelchair from being folded, used indoors and maneuvered in and out of motor vehicles.

The fact is wheelchair users are not limited to just being outdoors. Wheelchair users are working individuals, shoppers, students, parents and regardless of their individuality wheelchair users all share the same expectations and desires concerning the mobility of their wheelchair which is to have convenience and accessibility with added on accessories for the wheelchair that will make their lives easier instead of more difficult. The purpose of the wheelchair is to provide mobility for the user and enhance the lives of the user. The installed previously existing wheelchair warning light apparatus when installed onto the wheelchair is just not convenient for the user or the wheelchair.

As a matter of fact if the previously existing warning lamp apparatus were made available today, the wheelchair user would be faced with the task of constantly having to remove the apparatus from the wheelchair and install it over And over again every time the wheelchair is required to be used indoors, be maneuvered in and out of a motor vehicles or used in a public restroom facility. Once the apparatus has been removed, the user is now faced with the reality of having to either haul the apparatus around with them or is faced with the task of finding a suitable safe and responsible place to store the removed apparatus until the user returns to retrieve the apparatus and install it onto the wheelchair again. My invention eliminates these burdens, matters and concerns.

Simply stated, the previously existing warning lamp apparatus for the wheelchair is not user friendly or convenient enough to be considered useful for its purpose. It is also probably one of the reasons why the previously existing warning lamp apparatus for the wheelchair has failed to succeed in being made available to wheelchair users today and possibly one of the reasons why wheelchair users are still mounting flags and tennis balls hung on a pole attached to their wheelchair in hopes of being seen by vehicle motorist while traveling on dimly lit streets. These methods however are not effective enough for adequately allowing vehicle motorist to visibly see the wheelchair user in time enough to avoid collision. In the meanwhile wheelchair users still remain at risk. It is apparently very clear an improvement upon the previously existing wheelchair warning lamp apparatus is very much needed and here is a void that desperately needs to be filled.

A more acceptable and suitable warning light apparatus for the wheelchair to best serve the need of the wheelchair user will conform to both outdoor and indoor use, will allow the chair to be folded without removal of the installed apparatus from the wheelchair and would not required drilling holes into the wheelchair in order to be installed onto the wheelchair. My improvement upon the alignment of the wheelchair warning light and lamp apparatus provides an extendible and retractable erected pole apparatus with an inner and outer pole casing, a battery housing support member connected to the outer pole casing and a battery housing support member attached on the bottom end of the outer pole casing forming a pole and battery assembly with an overhead safety light and audible alert equipment installed on the top part of the erected inner pole. Unlike the previously apparatus, my improvement upon the alignment of the previous apparatus enables a more appropriate alignment more suitable for the attachment of a safety light apparatus to be installed on only one side of the wheelchair whereas it decreases the chances of being an obstruction on the wheelchair and will not interfere with the operation of the wheelchair. This improvement upon the alignment also allows the wheelchair to be folded without having to remove the installed apparatus from the wheelchair. If my invention were made available it would be well received.

My improvement upon the mounting of the previous existing warning light apparatus provides a battery housing support member that is attached to the bottom of the pole as the mounting base for the wheelchair warning light and lamp apparatus. Three C-Clamps vertically and horizontally attached on the side of the battery housing are used to clamp the battery housing as the mounting base onto the vertical and horizontal lower frame support of the wheelchair whereby installing the attached pole with safety light and audible alert apparatus onto the wheelchair without drilling required.

My improvement upon the installation of the previously apparatus provides a pole and battery apparatus that is installed onto the wheelchair with an easy maneuver of rotating the battery and pole assembly back at a 45 degree angle, aligning the C-Clamps on the side of the battery case around the vertical support of the chair's frame then rotating the assembly back to its upright position and sliding it down the vertical support until the C-Clamp on the bottom of the battery case fastens onto the horizontal support of the wheelchair.

My improvement upon the mounting and installation of the previously existing wheelchair warning light and lamp apparatus eliminates the need to drill holes into the wheelchair to install the warning light apparatus onto the wheelchair. If my invention were made available it would be well received.

My improvement upon the previously existing warning lamp apparatus for the wheelchair provides erected cylinder shaped extendible and retractable erected pole with an inner casing and outer pole casing. A pole lock nut installed on the pole's outer casing allows the overhead safety light and audible alert to be raised high over the user's head. The pole lock nut installed on the outer casing also enables the pole to be locked in place. The raised pole can be lowered down to the user's head to allow the wheelchair to be used indoors, maneuvered in and out of buses, vans, motor vehicles and public restroom facilities without the removal of my installed apparatus from the wheelchair. If my invention were made available it would be well received.

My pole and battery safety light and audible alert invention for the wheelchair is a rechargeable battery operated apparatus that is operated with a control switch mounted on the armrest of the wheelchair. There are two outlets on the battery housing case, one for the control switch plug in outlet and one for the rechargeable battery plug in outlet. A 12 volt rechargeable battery as the source of electrical power for the wheelchair safety light and audible horn alert apparatus illuminates the revolving safety light and sounds the audible alert. If my invention were made available it would be well received.

My invention provides an overhead safety light that is attached on top of an erected pole clamped onto one side only of the wheelchair and will not interfere with the operation of the wheelchair and will allow the wheelchair to be folded and used indoors without removal of the installed safety light apparatus from the wheelchair and will also enable vehicle motorist to visibly see the overhead revolving flashing lights illuminating the presence of the wheelchair and user traveling in dimly lit areas of traffic in time enough to slow down or stop while allowing the wheelchair user time to exit to safety.

My invention, which can be installed without drilling required, and is removably attachable. My invention is the beginning of a new era for the wheelchair. My invention will revolutionize the way wheelchair industries will rethink on wheelchair safety and the way wheelchair users will travel. My improvement upon the alignment, installation, mounting and support of a wheelchair warning light apparatus will enable wheelchair user to be provided with a safety warning light equipment for the wheelchair that is able to be installed onto the wheelchair easily and quickly without drilling required and will allow the user to fold and operated the wheelchair without interference of the apparatus upon the wheelchair. Furthermore my invention will enhance the lives of the wheelchair users and fill a void that is long overdue and desperately need to be filled. If my invention were made available it would be well received.

SUMMARY OF THE INVENTION

The object of this present invention is to provide an apparatus that improves upon the previously existing wheelchair warning lamp apparatus that fails to allow the wheelchair to be folded and used indoors when it is installed onto the wheelchair and require holes to be drilled into the wheelchair hand guide rail in order to install the previously existing warning lamp apparatus onto the wheelchair.

In the patent of the previously existing wheelchair warning lamp, i.e. [1]BRYANT, CONNIE, 1998, Wheelchair Warning Lamp, Umbrella and Accessory Storage Apparatus, U.S. Pat. No. 5,791,761, Filed Jul. 1, 1996 and Issued Aug. 11, 1998, in the BACKGROUND OF THE INVENTION, It is stated "one problem with mounting a warning lamp on a wheelchair for use in traffic, is that it is difficult to adequately and removably support such a lamp to a wheelchair, so that it may be removed when the wheelchair is folded or used indoors. Also in order to install the apparatus onto the wheelchair it is stated in the DESCRIPTION OF THE INVENTION, "It is also necessary to drill through the guide support arms 23 and the underlying frame to provide holes for the spring loaded buttons 32." In regards to this previous statement it is therefore the object of this present invention to solve the previously existing problems identified in the BACKGROUND OF THE INVENTION and provide a warning lamp apparatus for the wheelchair that will allow the wheelchair to be folded, used indoors, be maneuvered in and out of buses, vans, cars, public restroom facilities and operated anywhere a typical wheelchair should normally be able to be operated without the removal of the installed warning lamp apparatus from the wheelchair and be able to be installed without drilling required.

Although the wheelchair is more than five hundred years old and more than five thousands wheelchair accessories have been invented for the wheelchair, there is not any overhead upright wheelchair warning lamp apparatus made available to wheelchair users today. However; there is one wheelchair warning lamp apparatus that has been patent, nevertheless it fails to be convenient enough to be useful for its purpose.

The purpose of the wheelchair is to enhance the life of the user. However; if this apparatus were made available to the user today, the user would be faced with the challenges of constantly installing and removing the apparatus from the wheelchair every time the wheelchair were required to be used indoors, folded or transported in a motor vehicle. Once removed from the wheelchair the user would either be faced with hauling the apparatus around or faced with having to find a safe and suitable place to store the apparatus until the wheelchair is required to be used outdoors again. Also for individual who use rental wheelchair their only alternative would be to go without and remain at risk since it would not be permissible to drill onto the rental wheelchair. Basically the previously existing wheelchair warning lamp apparatus when mounted onto the wheelchair becomes an obstruction that prevents the wheelchair from being folded and used indoors without first having to remove the installed warning light apparatus from the wheelchair which is probably why wheelchair users are still mounting tennis balls and flags on top of a pole attached onto their wheelchairs, however; these methods are not effective enough for allowing vehicle motorist to visibly see the wheelchair user traveling on dimly lit streets in enough time to stop or slow down while allowing the wheelchair user time to exit to safety. In the mean time wheelchair users are still at risk and are searching for solutions to help vehicle motorist to visually see them while traveling along dimly and poorly lit areas on the roadway and in traffic.

Therefore it is the object of this present invention to provide an improvement upon the alignment, mounting, installation and support of the wheelchair warning lamp apparatus and solves the problems of the previously existing wheelchair warning lamp apparatus identified in the BACKGROUND OF THE INVENTION by providing a battery housing support member with two clamps installed on the back side of the battery housing and an extendible and retractable cylinder shaped erected pole with an inner and outer pole casing, whereby a safety light and audible alert is installed on the top end of the inner pole casing, whereas two clamps attached on the back side of the battery housing are clamped around the lower end of the outer pole casing connecting the pole and battery housing together forming a pole and battery assembly. Furthermore three vertically and horizontally C-Clamps attached on the side of the battery housing support member clamp onto the vertical and horizontal lower frame support of the wheelchair on one side only to install the pole and battery assembly revolving safety light with audible alert apparatus onto the wheelchair without drilling or hand tools required.

The control switch housing is mounted onto the wheelchair lower arm rail support and is attached using plastic fasteners. Unlike the previously existing wheelchair warning lamp apparatus my invention provides an improvement upon the alignment whereas when installed onto the wheelchair it is not an obstruction that hinders the mobility and operation of the wheelchair and does not require removal of the installed warning lamp apparatus from the wheelchair in order to fold the wheelchair, use the wheelchair indoors, and transport the wheelchair in a motor vehicle.

Unlike the previously existing wheelchair warning lamp apparatus that requires drilling to be installed, my invention a clamp-on pole and battery assembly can be installed within seconds by clamping the vertical and horizontal C-Clamps attached on the side of the battery housing onto the lower vertical and horizontal frame support of the wheelchair without having to drill holes into the wheelchair. The control switch housing is easily attached onto the lower arm frame support with using plastic fasteners.

Unlike the previously existing wheelchair warning lamp apparatus, my apparatus provides a more suitable solutions for persons who are physically challenge by allowing the user to clamp the apparatus onto the wheelchair and travel freely without the concerns of having to removed the installed apparatus from the wheelchair whenever the chair is required to be transported in motor vehicles, used indoors or folded. Even more importantly my apparatus will finally fill a void that is much needed to be filled and if my invention were made available today it would be well received.

BRIEF DESCRIPTION OF THE DRAWINGS

FIG. 1 is a perspective view of the back of an unfolded wheelchair with the wheelchair clamp-on extendible and retractable pole and battery overhead rechargeable battery operated safety light and audible alert assembly apparatus for the wheelchair mounted onto the back of the wheelchair. In addition what is shown is a view of the revolving safety light and audible alert device mounted on the top of the inner pole casing raised high over the wheelchair and locked in place with the twist pole lock nut installed on top of the outer pole casing on the side near the hand guide rail. Furthermore what is visible to see is a partial rear view of the battery housing that is attached to the bottom end of the outer pole casing with two clamps clamped around the lower end of the erected outer pole casing forming a pole and battery assembly.

FIG. 2 another view is provided showing the back of an unfolded wheelchair with the clamp-on portable battery operated pole and battery assembly erected overhead safety light with an audible alert apparatus mounted onto the back of the wheelchair with the erected overhead revolving portable safety light lowered down to the hand guide rail and in a non-raised position. Also, what is shown and will be described in greater detail is a partial view of the control switch plug in cord shown beneath the left wheelchair arm rail, shown a partially behind the back of the wheelchair, and resting on top of the battery housing. The control switch will be described later in greater detail.

DETAILED DESCRIPTION OF THE PREFERRED EMBODIMENT

Figure 3:
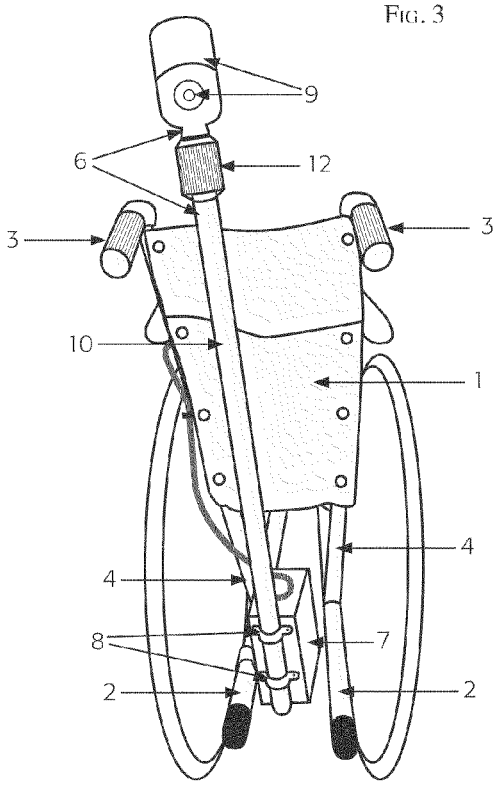
FIG. 3 is a perspective view of the back of a wheelchair in a folded position with a view of the installed clamp on portable pole and battery safety light with audible alert apparatus for the wheelchair installed on the back of the folded wheelchair with the overhead revolving safety light with an audible alert equipment in a non-raised position. What is visible to see is the twist lock nut device installed on top of the pole's outer casing and the revolving safety light with audible alert equipment lowered down near the hand guide rail. What is also visible to see is that the portable clamp on safety light and horn alert apparatus is clamped onto one side only of the wheelchair allowing the wheelchair to be folded without removal of the installed safety light apparatus from the wheelchair.

Referring to FIG. 1, what is visible to see is a perspective drawing of the back of an unfolded wheelchair (1) with the clamp-on extendible and retractable pole and battery overhead rechargeable battery operated revolving safety upright warning lamp and light apparatus (6) for the wheelchair installed onto one side only on the back of the unfolded wheelchair (1). What is visible to see is the revolving safety light with audible horn alert device (9) mounted on top of the inner pole casing (11) raised high over the wheelchair (1) and locked in place with the twist pole lock nut device (12). The twist lock nut is installed on the top end of the outer pole casing and slightly above the hand guide rail (3) the outer pole casing (10). Furthermore what is visible to see is a rear view of the battery housing (7) shown mounted with two clamp (8) attached around the lower end of the outer pole casing (10) connecting the outer pole casing (10) to the battery housing (7).

Referring to FIG. 2 Another view is provided with the clamp on pole and battery warning light with audible horn alert apparatus (6) shown mounted onto the back on an unfolded wheelchair (1) with the overhead warning light and horn alert device (9) in a non raised position and lowered down to the hand guide rail (3). What is also visible to see is a partial view of the control switch plug in cord (13) shown beneath the wheelchair left (14) arm rail, shown partially behind the back of the wheelchair (1) and resting on top of the battery housing (7). The control switch plug in cord will be described later in greater detail.

FIG. 3 provides a view of the back of a folded wheelchair (1) with the installed clamp-on portable battery operated pole and battery assembly upright overhead warning light and lamp with an audible horn alert apparatus (6) for the wheelchair mounted onto the back of the wheelchair (1) in a non-raised position. What is visible to see is the twist pole lock nut device (12) shown mounted on top of the upright outer pole casing (10). What is also visible to see are two clamps (8) attached on the back side of the battery housing (7) and is clamped around the bottom end of the outer pole casing (10) forming the pole and battery assembly as a unit. In addition what is visible to see is the upright warning light and audible horn alert apparatus (6) mounted onto one side only of the folded wheelchair's lower vertical (4) and horizontal (2) frame support.

Figure 4:
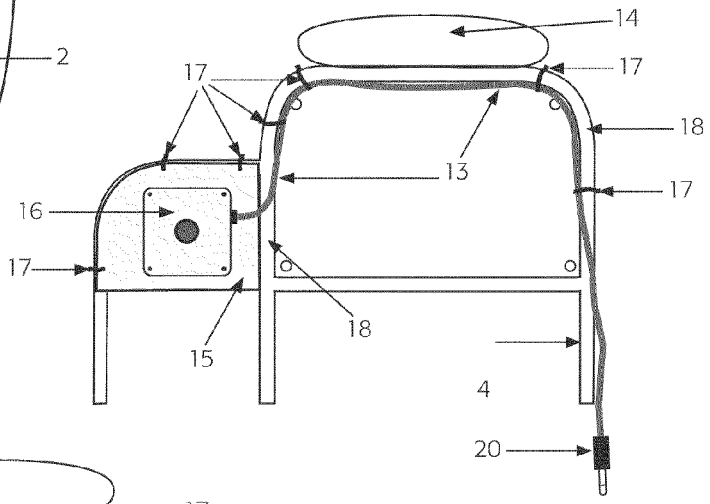
FIG. 4 provides a side view of the wheelchair arm support rail with the control switch housing mounted onto the lower frame support of the arm rail. What is also shown is the control switch connecting plug in cord that is fastened along the side of the arm rail support with plastic fastener ties to secure the cord in place while allowing the plug in adapter to hang down loosely along the lower arm rail support.

Referring to FIG. 4 what is shown is a perspective drawing of the wheelchair arm support (14) with the warning light apparatus control switch housing (16) mounted onto the side of the wheelchair lower frame support (15). What is visible to see is a drawing of the plug in cord (13) connecting from the control switch housing (16), and attached along the sides of the arm rail frame support (18) secured with plastic fastener ties (17) that secures the plug in cord (13) onto the chair's arm rail frame support (18). Furthermore what is featured is the plug in cord adapter (20) hanging down loosely along the bottom vertical rail support (4).

Figure 5:
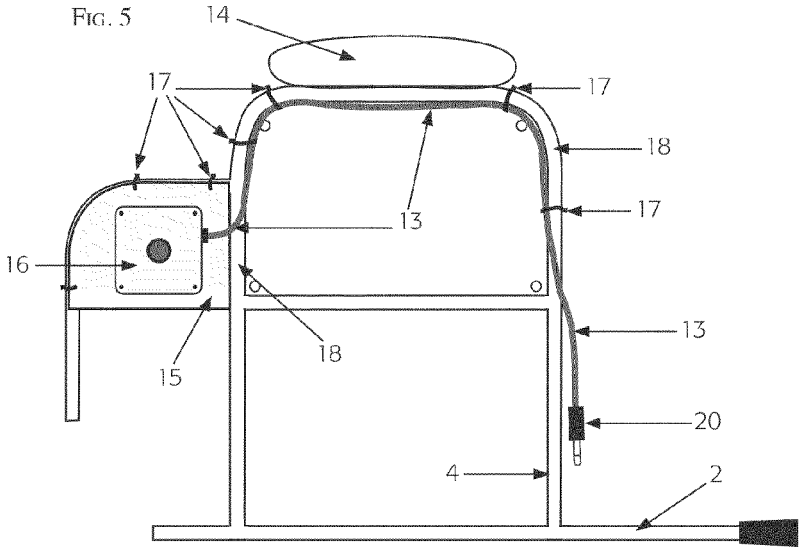
FIG. 5 provides a side view of the wheelchair arm support rail and the bottom of the wheelchair lower vertical and horizontal frame support connected together. What is provided is a view of the control switch housing for the clamp on wheelchair portable safety light apparatus mounted along the sides of the arm rail support secured with plastic tie fasteners in addition what is seen is the plug in cord adapter shown hanging loosely along the wheelchair lower vertical frame support and over the horizontal lower bottom frame support of the wheelchair.

Referring to FIG. 5 what is provided is another side view of the wheelchair arm rail support (14) with the control switch housing (16) mounted onto the lower arm rail of the wheelchair arm frame support (15). In addition what is shown is the wheelchair arm rail support (14) connected to the wheelchair lower vertical (4) and bottom horizontal frame support (2). What is visibly to see is the control switch cord (13) connecting from the control switch housing 16 secured along the side of the chair's arm rail frame (18) with plastic fastener ties (17) with the plug in cord adapter (20) hanging down loosely along the chair's bottom vertical frame support (4) and over the bottom horizontal support (2) of the wheelchair.

Figure 6:
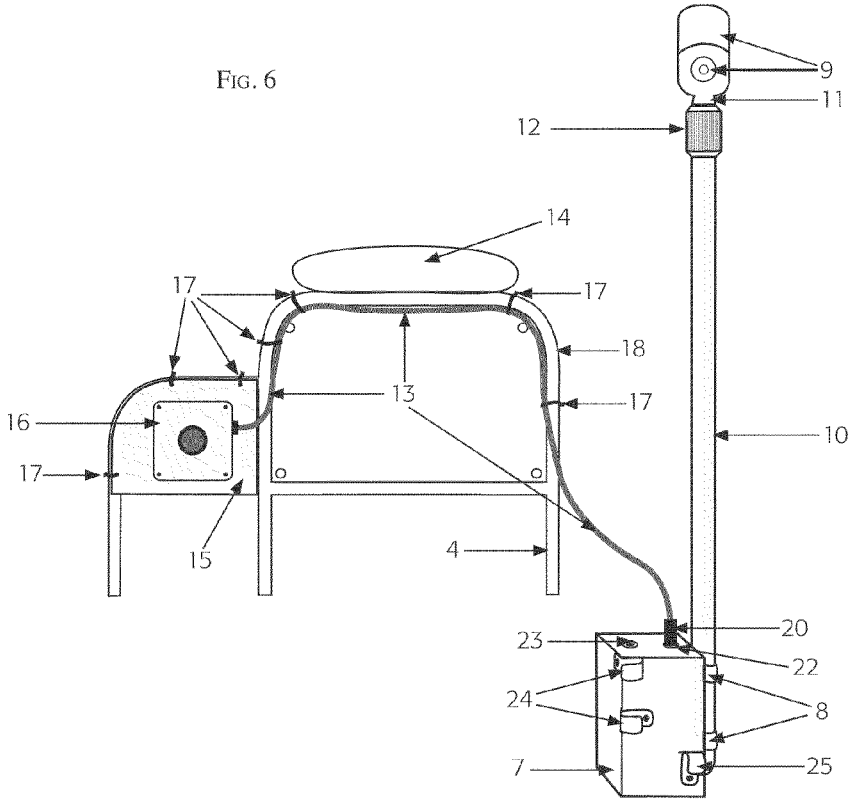
FIG. 6 provides a figure of a wheelchair arm support rail with the control switch housing for the clamp on safety light apparatus mounted onto the chair's lower arm frame support with the control switch connected plug in adapter shown plugged into the battery housing plug in outlet located on the top of the battery housing. What is also visible to see is the battery housing and pole assembly connected together and the overhead safety light apparatus installed on top of the upright inner pole casing. Furthermore what is visible to see on the posterior side of the battery housing are two clamps attached around the lower end of the erected outer pole forming the pole and battery assembly. Also what is visibly shown are three C-Clamps mounted on the lateral side of the battery housing, two C-Clamps placed in a vertical position are arranged in opposite directions of the other. Furthermore what is visible to see is one C-Clamp mounted on the bottom of the battery housing on the same side, placed in a horizontal position. The Vertical and Horizontal C-Clamps installed on the battery housing are used to mount the upright pole and battery assembly warning light apparatus onto the vertical and horizontal frame support of the wheelchair.

FIG. 6 provides a figure of a wheelchair arm rail (14) with the clamp on warning light apparatus housing for the control switch (16) mounted onto the lower frame support (15) of the chair's arm rail (14). What is visible to see is the control switch plug in adapter (20) connected into the control switch plug in outlet (22) located on top of the battery housing (7). What is also visible is the rechargeable battery plug in outlet located on top of the battery housing. Furthermore the battery housing is shown connected to the upright tubular outer pole casing (10) with warning light with audible horn alert device (9) installed on top of the tubular inner pole casing. (11). What is also visible to see are two C-Clamps (24) vertically attached to the side of the battery housing (7) and facing in opposite direction of the other with one C-Clamp attached horizontally (25) on the bottom of the battery housing (7) to connect the warning light device (9) onto the wheelchair vertical (4) and horizontal (2) bottom and lower frame support. In Addition what is shown are two Clamps (8) attached on the battery housing (7) are connected around the lower end of the outer pole casing (10) forming a pole and battery assembly.

Figure 7:
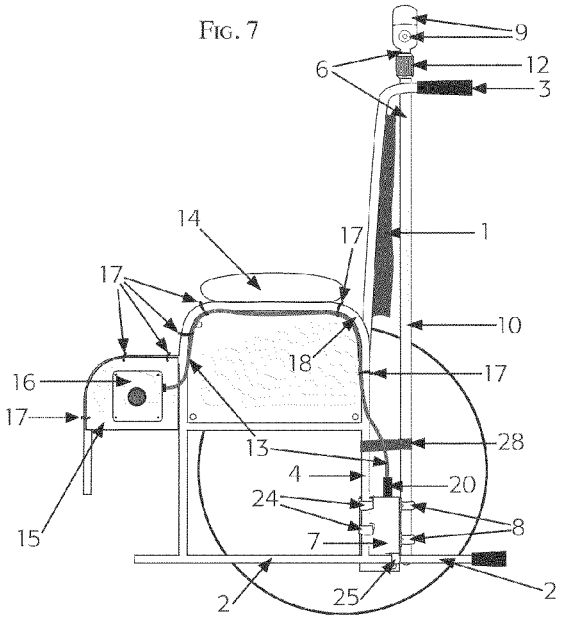
FIG. 7 provides a side view of the arm rail of the wheelchair connected to the back of a frame of a wheelchair with the portable clamp on revolving safety light with audible alert installed onto the back of the wheelchair. What is visible to see is the control switch mounted on the side of the lower arm rail frame support with the connecting plug in cord shown connecting from the control switch housing along the sides of the arm rail frame support and the plug in adapter shown connected at the end of the plug in cord and is shown plugged into the battery housing plug in outlet on top of the battery housing that is connected on the lower vertical and horizontal frame support of the wheelchair. What is visible to see is the overhead upright warning light and audible horn alert device lowered down to the wheelchair hand guide rail. Also visible to see is an outline of the wheel of the wheelchair and through it what is visible to see are two vertical C-Clamps that are attached on the side of the battery housing are clamped onto the lower vertical frame support of the wheelchair with the horizontal frame support clamped onto the horizontal bottom frame and rail support of the wheelchair. Also what is clear to see is a Velcro strap that is attached around the outer pole casing attached around the lower end of the vertical frame support of the wheelchair.

FIG. 7 provides a drawing of the arm rail of a wheelchair (14) with the portable clamp on revolving warning light with audible horn alert apparatus (6) mounted on the back of the wheelchair (1) in a non raise position. What is shown are two clamps (8) that are attached on the back side of the battery housing (7) are clamped around the lower end of the outer pole casing (10) connect the battery housing (7) and upright pole (10) together. What is also shown are two C-Clamps (24) vertically attached on the lateral side of the battery housing (7) are clamped onto the wheelchair lower vertical frame (4) support with one C-Clamp horizontally (25) attached on the bottom of the battery housing (7) is shown mounted onto the bottom horizontal frame support (2) of the wheelchair. What is also available to see is a Velcro strap (28) mounted on the lower end of the upright pole outer casing (10) and slightly above the battery housing (7). The Velcro strap (28) is optional.

Figure 8:
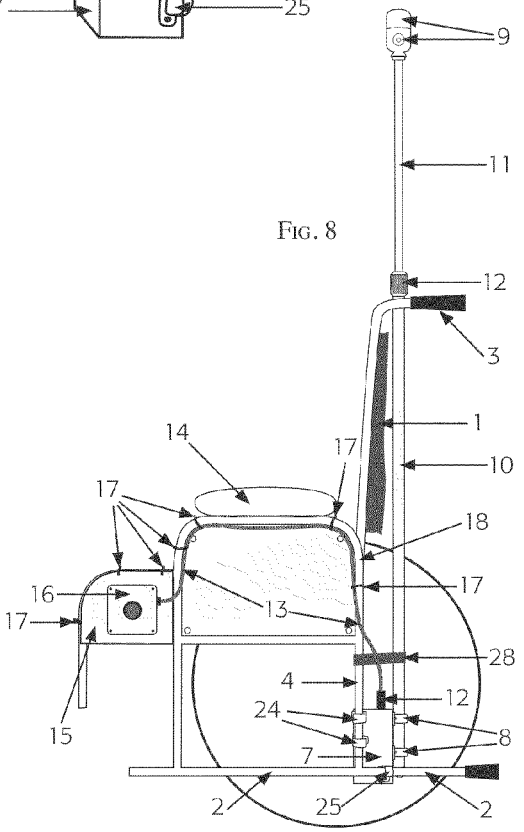
FIG. 8 provides another side view of the arm rail of the wheelchair connected to a wheelchair and the portable clamp on revolving warning light with audible horn alert installed onto the back of the wheelchair frame support. What is visible to see is the control switch mounted on the side of the lower arm rail frame support with the connecting plug in cord shown connecting from the housing along the side of the arm rail frame support with the plug in adapter shown plugged into the battery housing plug in outlet on top of the battery housing that is connected on the lower vertical and horizontal frame support of the wheelchair. What is visible to see raised high over the wheelchair is the overhead upright warning light and audible horn alert device installed on the upright inner pole casing and what is also clear to see is the pole twist lock nut installed on top of the outer pole casing and slightly above and near the hand guide rail of the wheelchair. Also visible to see is the wheelchair vertical lower frame support and the two vertical C-Clamps that are attached on the side of the battery housing are clamped onto the lower vertical frame support of the Wheelchair and the C-Clamp installed on the bottom of the battery housing is clamped onto the horizontal and bottom rail of the chair support. Also what is clear to see and is optional to use is a Velcro strap that is attached around the outer pole casing attached around the lower end of the vertical frame support of the wheelchair.

FIG. 8 Provides a drawing of the arm rail of a wheelchair (14) with the portable clamp on revolving warning light with audible horn alert apparatus (6) mounted on the back of the wheelchair (1) shown raised high over the wheelchair. What is shown are two clamps (8) that are attached on the back side of the battery housing (7) are clamped around the lower end of the outer pole casing (10) to connect the battery housing (7) and upright outer pole casing 10) together. What is also shown are two C-Clamps (24) vertically attached on the lateral side of the battery housing (7) are shown clamped onto the wheelchair lower vertical frame (4) support with one C-Clamp in a horizontal position (25) shown clamped onto the wheelchair bottom horizontal frame support (2) to install the warning light apparatus (6) onto the wheelchair (1) on one side only without drilling or hand tools required. What is also to view is a Velcro strap (28) on the lower outer pole casing (10) securely attached around the vertical bottom frame support of the wheelchair (4) for extra support of securing movement of the installed warning light apparatus (6).

While the invention has been described with a certain degree of particularity, it is manifest that many changes may be made in the details of construction and the arrangement of components without departing from the spirit and scope of this disclosure. It is understood that the invention is not limited to the embodiments set forth herein for the purposes of exemplification, but is to be limited only by the scope of the attached claim or claims, including the full range of equivalency to which each element thereof is entitled.

What is claimed is:

1. A wheelchair warning lamp apparatus, comprising: a clamp-on assembly for a wheelchair, comprising: an extendible and retractable cylinder shaped erected pole; a battery assembly with rechargeable battery; and a rechargeable battery operated overhead rotating safety light and audible alert assembly apparatus, wherein the overhead rotating safety light and audible alert assembly apparatus is installed on the top end of an extendible and retractable cylinder shaped inner pole casing.

2. The wheelchair warning lamp apparatus as recited in claim 1, wherein the extendible and retractable cylinder shaped erected pole is portable and comprises the inner pole casing and an outer pole casing.

3. The wheelchair warning lamp apparatus as recited in claim 1, further comprising: a battery housing with two clamps provided on the posterior side of a battery housing support member so that the battery housing is capable of being clamped around the lower end of an outer pole casing of the extendible and retractable cylinder shaped erected pole thereby connecting the battery housing and pole together to form the clamp-on assembly for the wheelchair.

4. The wheelchair warning lamp apparatus as recited in claim 1, further comprising: a battery housing support member with two vertically attached C-Clamps on the upper lateral side of a battery housing and one horizontally attached C-Clamp connected on the lower lateral end of the battery housing that clamp the pole and the battery housing onto a vertical and horizontal lower frame support of the wheelchair without drilling required.

5. The wheelchair warning lamp apparatus as recited in claim 1, wherein the extendible and retractable cylinder shaped erected pole is connected to a battery housing support member, and further comprising a battery housing with two plug-in outlets installed on the top of the battery housing, comprising a control switch plug-in outlet and a rechargeable battery plug-in outlet.

6. The wheelchair warning lamp apparatus as recited in claim 1, wherein the inner pole casing is enclosed within an outer pole casing that is connected to a battery housing support member.

7. The wheelchair warning lamp apparatus as recited in claim 1, further comprising: a twist lock nut device installed on the top end of an outer pole casing allowing the rotating safety light with audible alert assembly apparatus installed on the top of the inner pole casing to be extended over the wheelchair, locked into place, and lowered back down to a user's head level near a hand guide rail.

8. The wheelchair warning lamp apparatus as recited in claim 1, wherein the rechargeable battery comprises a 12 volt battery as a power supply source enclosed within a battery housing support member, thus connecting electrical power from the rechargeable battery and a control switch to the rotating safety light with audible alert assembly apparatus installed on the top of the inner pole casing in order to sound a beeping audible alert and illuminate a rotating safety light of the rotating safety light with audible alert assembly apparatus.

9. The wheelchair warning lamp apparatus as recited in claim 1, further comprising: a housing for a control switch that operates the rechargeable battery operated overhead rotating safety light with audible alert apparatus assembly for the wheelchair and the housing for the control switch is mounted onto a wheelchair arm rail lower frame support and is secured with plastic tie fasteners.

10. The wheelchair warning lamp apparatus as recited in claim 1, further comprising: a control switch cord connecting from a control switch housing is fastened along a wheelchair lower arm rail using plastic tie fasteners to secure the control switch cord along an arm rail frame support.

11. The wheelchair warning lamp apparatus as recited in claim 1, further comprising: a plug-in cord adapter connected at the end of a control switch cord is positioned along a wheelchair vertical lower rear frame support and is plugged into a control switch plug-in outlet located on the top of a battery housing, wherein the battery housing is clamped onto the wheelchair vertical lower rear frame support and a horizontal rear frame support.

12. The wheelchair warning lamp apparatus as recited in claim 1, wherein the extendible and retractable cylinder shaped erected pole has an outer casing connected to a battery housing support member and further wherein the rechargeable battery operated overhead rotating safety light and audible alert assembly apparatus is portable.

13. The wheelchair warning lamp apparatus as recited in claim 1, wherein the clamp-on assembly is installed onto the back of the wheelchair with a maneuver of rotating the clamp-on assembly back at a 45 degree angle, aligning a C-Clamp on the side of a battery housing around a vertical support of the wheelchair frame, then rotating the clamp-on assembly back to its upright position and sliding it down the vertical support until a C-Clamp on the bottom of the battery housing fastens onto a horizontal support of the wheelchair.

14. The wheelchair warning lamp apparatus as recited in claim 1, wherein the clamp-on assembly clamps onto one side only of the wheelchair to allow the wheelchair to be folded and used indoors without the removal of the wheelchair warning lamp apparatus from the wheelchair.

15. The wheelchair warning lamp apparatus as recited in claim 1, wherein the rechargeable battery further comprises a 12 volt battery enclosed within a battery housing support member, and wherein lead wires connect the rechargeable battery with connecting wires throughout the inner pole casing and an outer pole casing, thus connecting to a control switch housing and the rechargeable battery operated overhead rotating safety light and audible alert assembly apparatus.

16. The wheelchair warning lamp apparatus as recited in claim 1, further comprising: a hook and loop strap attached on the bottom end of an upright tubular outer casing that is clamped around a wheelchair lower frame support.

17. The wheelchair warning lamp apparatus as recited in claim 1, wherein the clamp-on assembly is installed on one side only of the wheelchair to alert vehicle motorist of approaching wheelchair users traveling on dimly lit areas of traffic; and furthermore that the clamp-on assembly is able to be installed without drilling required and can be used indoors and out of doors without removal of the rechargeable battery operated overhead rotating safety light and audible alert assembly apparatus from the wheelchair.

* * * * *